US007398898B2

(12) United States Patent
Bouix et al.

(10) Patent No.: US 7,398,898 B2
(45) **Date of Patent: *Jul. 15, 2008**

(54) POUCH CONTAINER COSMETIC PACKAGE

(75) Inventors: Herve F. Bouix, New York, NY (US); Jonathan Thayer, Nutley, NJ (US)

(73) Assignee: Color Access, Inc., Melville, NY (US)

( * ) Notice: Subject to any disclaimer, the term of this patent is extended or adjusted under 35 U.S.C. 154(b) by 287 days.

This patent is subject to a terminal disclaimer.

(21) Appl. No.: 10/361,384

(22) Filed: Feb. 10, 2003

(65) Prior Publication Data

US 2003/0172950 A1 Sep. 18, 2003

Related U.S. Application Data

(63) Continuation-in-part of application No. 09/910,296, filed on Jul. 20, 2001, now Pat. No. 6,523,548.

(51) Int. Cl.
*B67D 5/06* (2006.01)
*A46B 11/00* (2006.01)

(52) U.S. Cl. ..... 222/183; 401/122

(58) Field of Classification Search ..... 132/218, 132/317, 320; 401/126, 122, 129, 156, 157, 401/118, 119, 120; 222/183, 105, 92–93
See application file for complete search history.

(56) References Cited

U.S. PATENT DOCUMENTS

| | | | | |
|---|---|---|---|---|
| 4,175,574 A | | 11/1979 | Zulberti | |
| 4,332,494 A | | 6/1982 | Kingsford | 401/5 |
| 4,370,989 A | | 2/1983 | Taylor | 132/79 B |
| 4,705,053 A | | 11/1987 | Goncalves | 132/88.7 |
| 4,780,017 A | * | 10/1988 | Bradford | 401/186 |
| 4,952,204 A | | 8/1990 | Kortweg | 604/1 |
| 4,982,838 A | | 1/1991 | Fitjer | 206/209 |
| 5,054,946 A | | 10/1991 | Morel | 401/122 |
| 5,137,387 A | | 8/1992 | Byrd et al. | |
| 5,324,128 A | | 6/1994 | Gueret | |
| 5,349,972 A | | 9/1994 | Dirksing et al. | 132/218 |
| 5,772,079 A | | 6/1998 | Gueret | |

(Continued)

FOREIGN PATENT DOCUMENTS

EP 0 677 456 A1 10/1995

(Continued)

OTHER PUBLICATIONS

EP Search Report, Jan. 26, 2005.

*Primary Examiner*—Robyn Doan
(74) *Attorney, Agent, or Firm*—Martin Haerter

(57) ABSTRACT

A cosmetic package has a sheet material pouch defining a product storage chamber, a neck member with a passage to the storage chamber, a cap on the neck member to close the passage and an applicator wand extending from the cap through the passage into the storage chamber. The pouch is securely attached to the neck member by way of pairs of horizontally extending wedges. The wedges form opposite outwardly directed, semi-elliptical bonding surfaces that intersect at an acute angle. The semi-elliptical bonding surfaces allow the sheet material of the pouch to transition smoothly about the neck member, such that the material can be reliably and imperviously secured to the neck member.

4 Claims, 7 Drawing Sheets

U.S. PATENT DOCUMENTS

| | | | | |
|---|---|---|---|---|
| 5,862,818 | A | 1/1999 | Marinelli | 132/312 |
| 5,873,491 | A | 2/1999 | Garcia et al. | |
| 6,142,344 | A | 11/2000 | Kai | |
| 6,142,692 | A | 11/2000 | Garcia | 401/122 |
| 6,474,890 | B1 * | 11/2002 | Gueret | 401/126 |
| 6,505,986 | B1 * | 1/2003 | Oder | 401/183 |
| 6,523,548 | B2 * | 2/2003 | Bouix et al. | 132/218 |
| 6,572,296 | B2 * | 6/2003 | Schrepf | 401/122 |

FOREIGN PATENT DOCUMENTS

| | | |
|---|---|---|
| FR | 2 733 673 | 11/1996 |
| JP | 56-108806 U | 8/1981 |
| JP | 04-80881 U | 7/1992 |
| JP | 9117322 | 5/1997 |
| JP | 2000253926 | 9/2000 |

* cited by examiner

POUCH CONTAINER COSMETIC PACKAGE

CROSS REFERENCE TO RELATED APPLICATIONS

This is a continuation-in-part of commonly assigned application Ser. No. 09/910,296, filed Jul. 20, 2001, now U.S. Pat. No. 6,523,548 which was allowed on Sep. 27, 2002, and which is incorporated by reference herein, in its entirety.

BACKGROUND OF THE INVENTION

1. Field of the Invention

The present invention relates to containers for holding cosmetics. More particularly, the invention relates to a cosmetic dispenser package having a pouch-like container portion.

2. Description of the Prior Art

Packaging arrangements for cosmetics, such as, for example, mascara, are often limited by design constraints that determine the shape of the product container and/or the material from which it is made. For example, in order for mascara product to be efficiently transferred onto an applicator inserted in the container, it is generally accepted that the dimensions and cross-sectional shape of the storage chamber should approximate those of the relatively long, cylindrical applicator typically found in mascara packages. For this reason, mascara containers generally have a relatively long cylindrical storage chamber. To avoid the use of excess packaging material, the external shape of the container generally closely approximates the shape and dimensions of the storage chamber. Also, the material from which a cosmetic container is made must generally be selected from one of a limited number of materials that are compatible with cosmetic products, e.g., glass, PE, PP, HDPE, POM, etc. The material should form a barrier that is impervious to escape of the product as well as impervious to contamination from external sources. However, packages having dimensions and made from materials most suitable from a functional and technical standpoint may not be as attractive or as appealing as packages having dimensions and made from materials that are functionally and technically less suitable.

This is particularly true in the cosmetics field, where the appearance and appeal of a package is often as important as the contents of the package. For example, in order to generate renewed consumer interest in a product, it is often desirable to change the appearance of the package by for example changing the shape or other esthetic qualities of the package, e.g., the material from which it is made. As a more specific example, it would be desirable to make a mascara package that has a unique shape, e.g., a pear shape. This is presently less practical because, if the shape of the product storage chamber approximates the external shape of the package, a significant quantity of product in the pear-shaped package would be inaccessible to the applicator brush because it would be too distant from the brush structure. Alternatively, if the shape of the storage chamber differs significantly from the external shape of the package, e.g., a cylindrical storage chamber in a pear-shaped package, substantial additional material would be required in the manufacture of the package to establish or to fill the void between the two shapes. While mascara packages are set forth herein as examples, the principles can be applied to the packages for other cosmetic products, including those that have design constraints less demanding than mascara packages.

U.S. Pat. No. 5,054,946 to Morel discloses an applicator device for cosmetics including an envelope that may have a non-circular cross-section which houses a container with a circular cross-section. The threaded neck and wiper of the device are formed as part of the envelope structure. Thus the envelope must be formed from materials suitable for making a threaded neck and a wiper, e.g., plastic or rubber. Accordingly, the materials from which the envelope can be made are substantially limited. Furthermore, the relatively complex structure of the combined envelope and container would likely add significantly to the cost of manufacturing, assembling and filling the device.

U.S. Pat. No. 5,862,818 to Marinelli discloses a disposable multi-sampler and fitment. The sampler comprises a paquette made of a multi-layer film with the fitment sealing an open end of the paquette. An applicator is provided in the fitment by way of a very thin breakable seal. The fitment has a collar with two wings extending from either side of the collar. An opening in the paquette is secured about the collar such that film of the paquette encloses and is bonded to the collar and the wings. The wings are quite thin, approaching the thickness of the film. This arrangement is said to assist in sealing the collar to the container as the two pieces will behave similarly and provide a good seal as the sampler goes through heat and dwell during the preferred method of manufacturing. It is less clear from the description how thicker portions of the collar will behave as the sampler goes through heat and dwell during manufacture. Accordingly, during manufacture of this arrangement, thicker portions of the collar may present sealing characteristics different from the wings. Furthermore, a relatively acute inside corner is formed at the intersection of the thicker portion of the collar and the base of the thin wings. The acute inside corner at the intersection of the collar and the wings may also present sealing problems during manufacture. In addition, it appears that the very thin breakable seal would not be suitable for repeated re-sealing cycles associated with a durable package used over a longer period of time.

A container with applicator for liquid cosmetics is disclosed in Japanese patent publication 9117322. The Japanese publication discloses a cylindrical container body having a bag within the container body. A coupling with a neck part supports the bag in an opening in the container body. A cap and applicator combination is supported on the neck part such that the applicator extends into the bag. A pressure board is provided in a window in the container body. Make-up material in the bag is said to be made to adhere to the applicator by pushing on the bag with the pressure board. The coupling with the neck part appears to be cylindrical, so the opening in the bag would need to be precision fit, or the manufacturing process would need to be carefully monitored, in order to ensure a secure and impervious seal.

A container and applicator for a cosmetic product, e.g., mascara, is disclosed in French Patent No. 2733673. The container has a rigid tubular body open at one end, an applicator in an inner space, and a neck formed by an insert with a collar and a wiper. Product is held inside the container in a pouch with a flexible wall that is subject to atmospheric pressure when the applicator is in use. In most of the embodiments depicted in the figures, the pouch appears to be attached directly to the rigid tubular body of the container, or sandwiched between the rigid tubular body and the neck insert. As with the previously described art, the attachment of the flexible pouch to the tubular body would need to be precision fit, or the manufacturing process would need to be carefully monitored, in order to ensure a secure and impervious seal.

Due to their shortcomings, it may not be possible to make the foregoing structures in a cost effective, reliable, high-speed manufacturing process.

Accordingly, there is a need for a durable pouch-like cosmetic package that can be made simply, cost effectively, reliably and at high manufacturing speeds.

BRIEF SUMMARY OF THE INVENTION

Disclosed is a cosmetic package comprising a pouch container defining a product storage chamber, a neck member with a passage to the storage chamber, a cap on the neck member to close the passage and an applicator wand extending from the cap through the passage into the storage chamber. The pouch container is securely and impermeably attached to the neck member by way of at least one pair of radially extending wedges. The wedges define opposite, outwardly directed semi-elliptical bonding surfaces on the neck member. A perimeter of an opening in the pouch container is fixedly attached to and forms an impervious seal with the bonding surfaces. A second end of the neck member opposite the first end has threads or other engaging means for receiving the cap. The passage from the first end to the second end of the neck member provides access through the neck member to product stored in the storage chamber.

The cap is cooperatively threaded or otherwise adapted to be received on the second end of the neck member such that the passage can be selectively opened and closed. An applicator wand has a proximal end connected to the cap and a distal end extending from the cap. The wand is dimensioned to be received in the passage and has a sufficient length to position the distal end of the wand within the storage chamber when the cap approaches the second end of the neck.

In addition, the package may be provided with means for creating a vacuum in the storage chamber. The means for creating a vacuum may, for example, take the form of an elastic annular ring, preferably in the form of an upwardly directed skirt, fixedly mounted about the wand and positioned at a location along a length of the wand corresponding to a point between first end and the second end of the neck when the cap is engaged on the second end. The ring has an outer dimension that is the same as or slightly larger than an inner dimension of the passage, and has a cross-sectional shape corresponding to that of the passage. The ring is configured and biased with respect to the passage such that compression in the chamber is released as the ring is pushed in the passage toward the chamber and a vacuum is generated in the chamber as the ring is withdrawn in the passage away from the chamber. This vacuum causes the pouch container to collapse a predetermined amount each time the wand is withdrawn from the passage. Other vacuum means are discussed in greater detail below.

DETAILED DESCRIPTION OF THE INVENTION

The present invention is directed to a cosmetic package comprising a pouch container, a neck member, a cap and an applicator wand.

Figure 1:
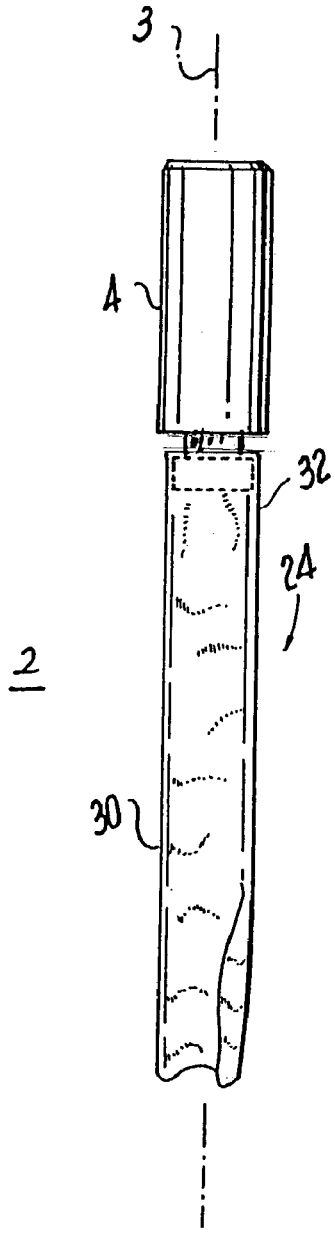
FIG. 1 is an elevation view of the cosmetic package of the present invention with the cap closed.
Figure 2:
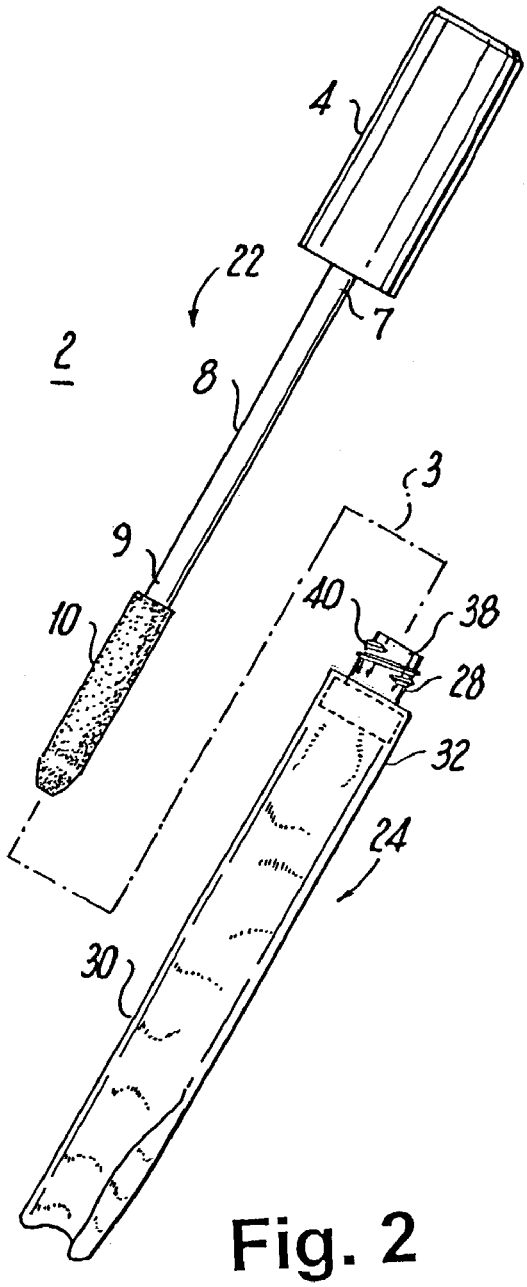
FIG. 2 is an exploded view of the package.
Figure 3:
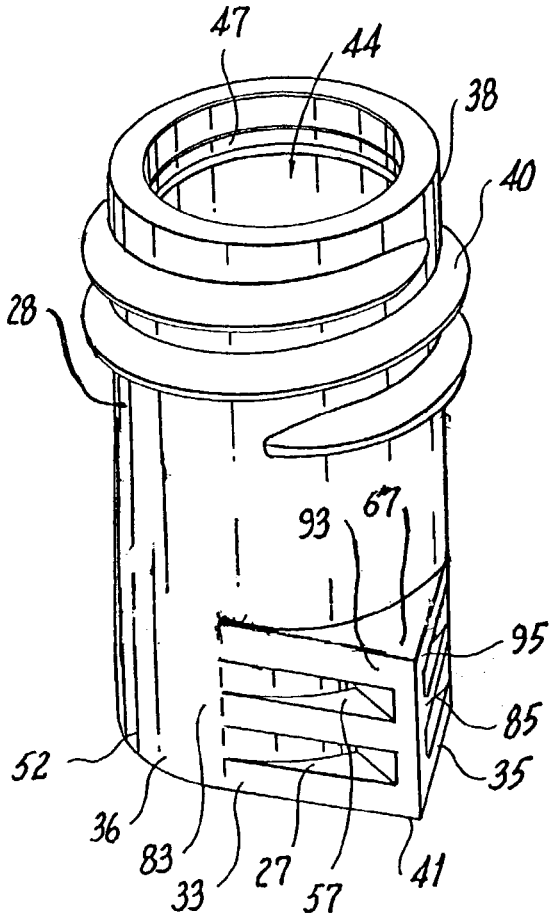
FIG. 3 is a top, front perspective view of the neck member of the present invention.
Figure 4:
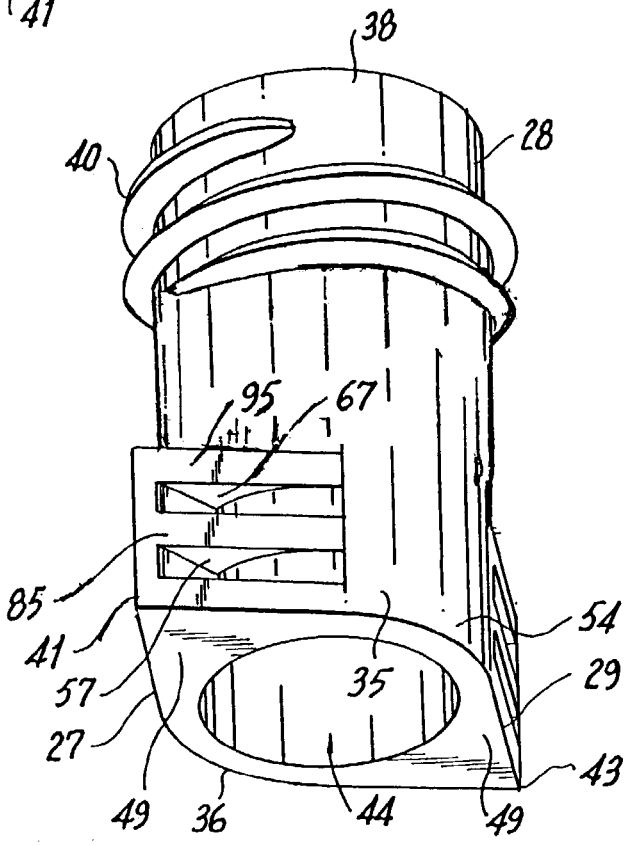
FIG. 4 is a bottom, front perspective view of the neck member.
Figure 5:
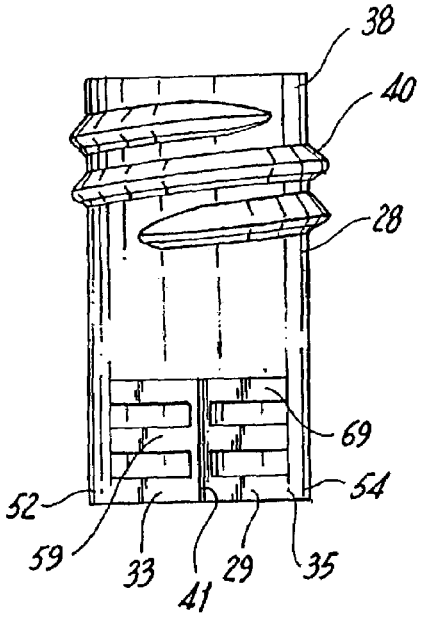
FIG. 5 is a front elevation view of the neck member.

Referring now to FIG. 1, a cosmetic package 2 according to the invention is shown with a cap 4. FIG. 2 shows the package 2 in an exploded view. The package 2 includes an applicator portion, shown generally at 22, and a container portion, shown generally at 24. The applicator portion 22 includes an applicator wand 8 with a proximal end 7 attached to the cap 4, and an applicator 10 supported on a distal end 9. The applicator 10 is shown here in schematic form for illustrative purposes. It will be understood that the applicator may be, for example, a brush, a comb, a sponge or fibrous material, a flocked material, or any other structure or arrangement suitable for carrying a supply of cosmetic from a product storage chamber and applying it to the skin, nails, hair (e.g., eyelashes), etc.

Figure 7:
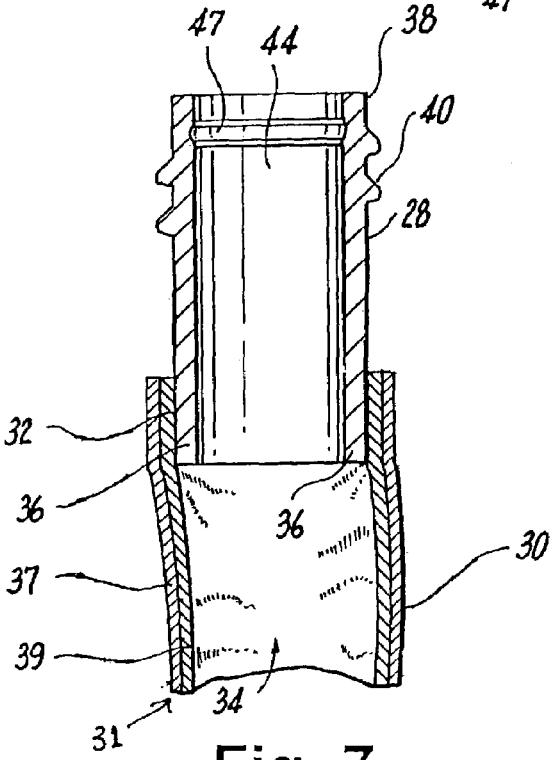
FIG. 7 is a sectional view of the neck member taken along line 7-7 in FIG. 6 with a top portion of the pouch container attached.

The container portion 24 includes a pouch container 30 and a neck member 28. The pouch container 30 defines a product storage chamber 34 (see FIGS. 7, 8 and 9) and has an opening 32 at one end. The pouch container 30 is made from a flexible sheet material 31, preferably a multi-layer laminate, such as, for example, an aluminum outer layer 37 and a plastic inner layer 39 (FIG. 7). It will be understood that the outer layer 37 is the side of the sheet material furthest from the product storage chamber 34 and the inner layer 39 is the side of the sheet material lining the product storage chamber 34. The plastic inner layer is preferably PE (polyethylene). Although shown for illustrative purposes as a two layer laminate in FIG. 7, it will be understood that the sheet material may be a single layer, or a multi-layer laminate having more than two layers. In FIGS. 8-14, while the sheet material 31 is represented as a single layer for illustrative purposes, it will be understood that this representation is intended to include multiple layer laminates. In any case, the material facing or lining the storage chamber 34 is selected to be both compatible with the product to be stored within the chamber and capable of being imperviously bonded or welded to the neck member 28.

The pouch container 30 is essentially made by forming the sheet material 31 into a pouch or bag-like structure with the opening 32 at one end. The pouch container 30 may be made, for example, from two sheets of the material, each sheet either a single layer or multi-layer material. The two sheets are sealed on at least three edges, leaving an opening at one end 32. Alternatively, one sheet of material may be folded along one edge and sealed on at least two other edges to form a pouch with one open end. As another alternative, the pouch or bag structure may be formed from a tubular sheet stock, e.g., made by extrusion. The tubular stock is cut into sections and one end is sealed to form a pouch with one open end. Each of the foregoing methods lends itself well to high speed, highly automated formation processes, as well as processes such as a "form/fill/seal" processes wherein the pouch container 30 is formed, bonded or welded to the neck member 28, filled with product, and sealed with an applicator 10, wand 8 and cap 4 in one cooperative production process.

The preferred multi-layer laminate for forming the container pouch is a thin outer layer 37 of aluminum (about 12 microns) and a thin inner layer 39 of PE (polyethylene)(see FIG. 7). Aluminum is preferred as the material for the outer layer 37 because it provides an excellent barrier to oxygen. Oxygen is known to contaminate and/or deteriorate certain cosmetic products, e.g., mascara. The PE inner layer 39 permits a strong plastic to plastic weld or bond, thus facilitating the secure, impervious attachment of the pouch container 30 to the neck member 28. The PE inner layer 39 also provides the necessary material compatibility with the cosmetic product to be stored within the pouch container.

Ideally, the pouch container 30 is made on automated process machinery, and assembled with the other components of the package 2 on the same machinery. The neck member 28, cap 4, wand 8 and applicator 10 may be separately formed, and fed into the automated process machinery for assembly with the pouch container 30. During or after assembly, the package 2 may be filled with product and sealed in the same process machinery, e.g., "form/fill/seal" process machinery.

Preferably, the neck member 28 is made from a HDPE (high density polyethylene) although other moldable plastic materials may also be suitable, e.g., PP (polypropylene), POM (acetal), etc. The neck member 28 is preferably made by injection molding. As best shown in FIGS. 3-7 and 14, the neck member 28 has a first end 36 and a second end 38 opposite the first end. As illustrated in FIG. 7 the first end 36 is fixedly attached to the opening 32 of the pouch container 30 such that an impervious seal is formed between the inner layer 37 of the pouch container 30 and an outwardly directed surface or surfaces of the neck member 28. The pouch container 30 is preferably attached to the neck member 28 by welding, e.g., ultrasonic, induction, etc. Other forms of bonding, welding, adhering or mechanical fastening (e.g., a clamp or ferrule arrangement) are also contemplated for connecting the pouch container to the neck member. The assembly of the package 2, including bonding or welding of the pouch container 30 and neck member 28 and assembly of the cap 4, wand 8 and applicator 10, may be conducted manually, but preferably all or at least some assembly steps will be automated. The cosmetic product, e.g., mascara, may be filled in the storage chamber 34 during or subsequent to assembly of the neck member 28 and the pouch container 30.

To facilitate the secure attachment of the pouch container 30 on the neck member 28, the first end 36 of the neck member is provided with at least one pair of horizontal wedges 27, 29 each extending radially from an opposite side of the first end 36 (see FIGS. 3-7 and 14). Each wedge 27, 29 is attached to the first end 36 by way of a base 49 that is substantially as broad as the width of the first end. Preferably, the base 49 is sufficiently broad to form a smooth transition with the structure of the first end 36. Each wedge 27, 29 tapers from the broad base 49 to a distal edge 41, 43, respectively, where the vertical sides of each wedge intersect to form an acute angle. Thus, the wedges 27, 29, together with intervening portions 52, 54 of the first end 36 define opposite outwardly directed semi-elliptical bonding surfaces 33, 35 extending between distal edges 41 and 43.

Figure 6:
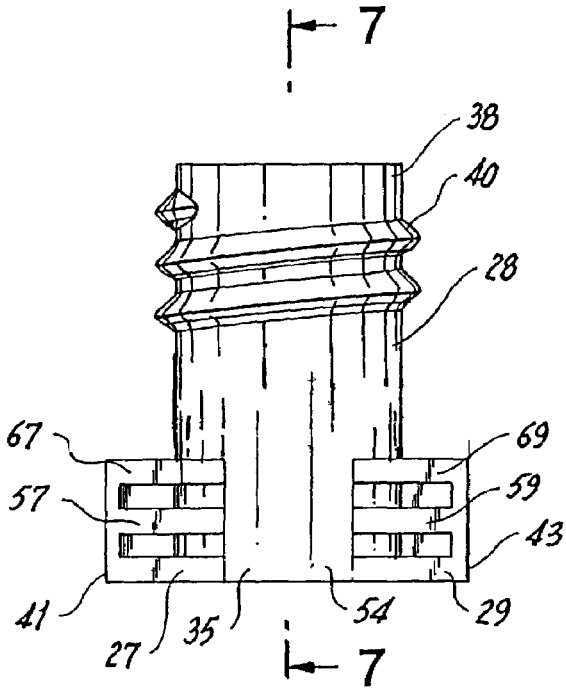
FIG. 6 is a side elevation view of the neck member.

In the preferred embodiment, the neck member has three pairs of opposite wedges, 27, 29, 57, 59, and 67, 69, respectively, (as best illustrated in FIG. 6). As described above with respect to wedges 27 and 29, each pair of wedges 57, 59 and 67, 69, together with corresponding intervening portions of the first end 36, defines opposite outwardly directed semi-elliptical bonding surfaces. Wedges 57 and 59, together with corresponding intervening portions of the first end 36, define bonding surfaces 83 and 85. Wedges 67 and 69, together with corresponding intervening portions of the first end 36, define bonding surfaces 93 and 95.

The opening 32 of the pouch container 30 is fixedly attached to and forms an impervious seal with at least one of the pairs of semi-elliptical bonding surfaces 33 and 35, 83 and 85, or 93 and 95, and preferably with all three pairs of bonding surfaces. In addition to attaching to the bonding surfaces, portions of the opening of the pouch container may also attach to corresponding portions of the first end 36 adjacent to the bonding surfaces, or with structure that bridges the space between adjacent wedges, e.g., portions of the edges 41, 43 that connect adjacent wedges. Because the bonding surfaces 33, 35, 83, 85, 93 and 95 are semi-elliptical, and because they intersect at an acute angle at edges 41 and 43 respectively, the sheet material 31 forming the opening of the pouch container 30 may be bonded about the first end with no need to conform to acute angles, etc. In other words, the sheet material 31 of the pouch is able to transition smoothly about both sides of the first end 36 of the neck member and meet beyond the acute edges 41, 43 of the wedges (see FIG. 14). The smooth transition of the sheet material 31 of the pouch about the bonding surfaces (e.g., 33, 35; 83, 85; and 93, 95) permits secure, leak-proof bonding or welding of the sheet material to the first end 36 of the neck member 28.

Because the sheet material 31 of the pouch transitions smoothly about the neck member on the semi-elliptical bonding surfaces, the size of the opening 32 of the pouch is less important than in prior art assemblies, and the location of the neck member in the opening is also less important. Essentially, the semi-elliptical bonding surfaces will form an impervious seal when placed anywhere between two layers of the sheet material. Thus, the opening in the pouch need not closely approximate the shape of the neck member as is the case with the prior art arrangements in order to attain an impervious adhesion. Any excess material bonds together beyond edges 41, 43 of the wedges. With the present arrangement, the smooth transition of the sheet material about the neck member on the semi-elliptical bonding surfaces allows for greater manufacturing tolerances before the pouch is secured to the neck member, yet consistently yields a reliable impervious bond, even at high manufacturing speeds. With the present arrangement, because any excess sheet material bonds together beyond the edges 41, 43 of the neck member, there is little chance that excess material will form a fold or overlap on the bonding surfaces of the neck member, thus yielding a leak. Furthermore, since the present arrangement does not present an acute inside corner on the bonding surfaces (as in the prior art construction), there is even less likelihood that a leak will form during manufacture. Accordingly, the structure of the present invention can be manufactured significantly more quickly, and with significantly less error or waste than previous cosmetic pouch packages. The added speed of manufacture and reduced waste translates directly into cost savings.

A passage 44 from the first end 36 to the second end 38 of the neck member 28 provides access through the neck member 28 to the product storage chamber 34. The second end 38 of the neck member 28 is provided with engaging means, e.g., threads 40, for receiving a closure member, i.e., the cap 4. The threads may be the same as those typically found on known mascara containers, e.g., 10 mm or 13 mm., or another suitable size. The cap 4 is provided with corresponding cooperative threads 42 on the inside (see FIGS. 8-9). Thus, the cap 4 and the second end 38 are cooperatively adapted to selectively open and close the passage 44 by known engaging cooperative means such as, for example, threads, bayonet mount, lug and detent, snap-fit, friction-fit, etc.

Figure 8:
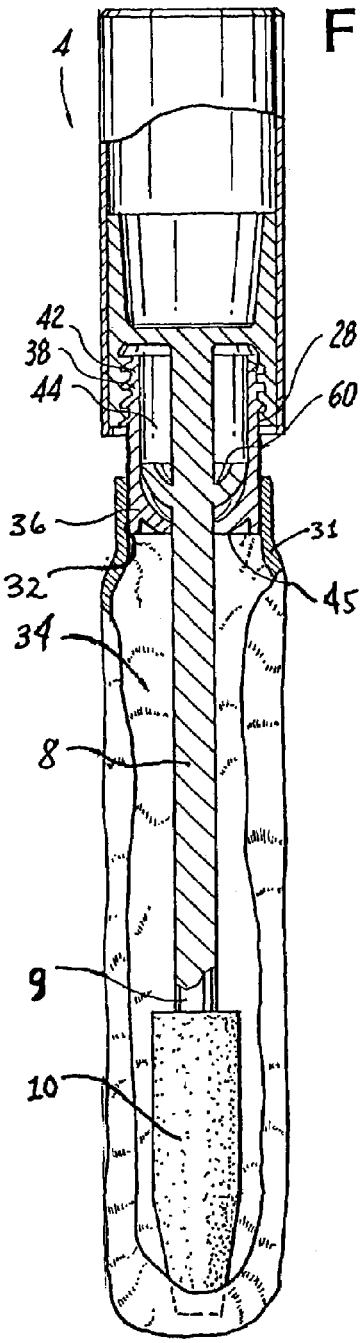
FIG. 8 is a sectional view of an alternative embodiment of the invention wherein the cap closes the passage and the wand is fully inserted, a wiper is integrally molded to the neck member and a vacuum means is provided.
Figure 9:
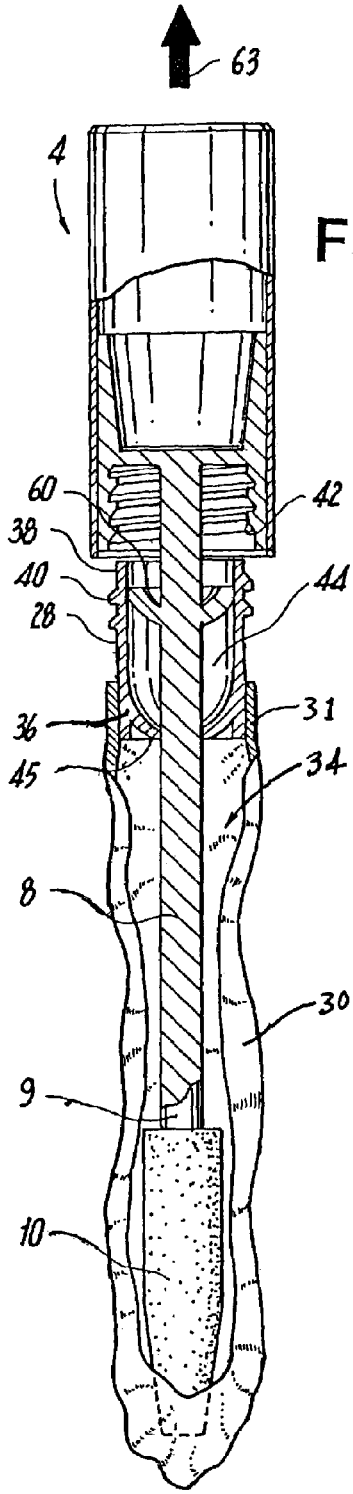
FIG. 9 is a sectional view of the embodiment shown in FIG. 11 showing the cap off and the wand partially withdrawn.

To assure that a pre-determined amount of cosmetic remains on the applicator 10 when it is withdrawn from the container 30, a wiper 45 (see FIGS. 8-9) in coaxial alignment with the passage 44 may be provided in the package 2. The wiper 45 may be integrally molded as part of the neck member 28 as shown in FIGS. 8-9. Alternatively, as is well known in the art, the wiper may be provided as a separate member (not shown) that snaps into an annular groove 47 (FIGS. 3 and 7) in the passage 44.

To facilitate the transfer of cosmetic product from the product storage chamber 34 onto the applicator 10, the package 2 is provided with vacuum means configured to draw air from the product storage chamber 34 to collapse the pouch container a predetermined amount each time the wand 8 is withdrawn from the passage 44. In its simplest form, the vacuum means may consist of the wiper 45 (see FIGS. 8-9) being cooperatively dimensioned and inwardly biased to closely fit the applicator wand 8 such that a vacuum is created on withdrawal of the applicator wand 8 from the package 2. Conversely, the wiper 45 and wand 8 are further configured and biased to release excess pressure from the package 2 that might occur upon insertion of the wand 8 into the package.

Alternatively, the vacuum means may consist, for example, of an elastic annular ring 60 (see FIGS. 8-9) preferably in the form of an upwardly directed skirt. The ring 60 may be a separate member fixedly mounted about the wand 8, or, as shown in FIGS. 8-9, an integrally molded component of the wand 8. The ring 60 is located along a length of the wand 8 at a position corresponding to a point between the first end 36 and the second end 38 of the neck member 28 when the cap 4 is close to or engaged with the second end 38. In other words, when the wand 8 is in the passage 44 and the cap 4 is close to or secured on the package 2, the ring 60 is positioned in the passage 44 proximal to the first end 36. The ring 60 has sectional shape and an outer dimension that is the same as or slightly larger than the sectional shape and inner dimension of the passage 44. Preferably, the passage 44 has a circular cross-section. The ring 60 is configured and biased with respect to the passage 44 such that compression in the chamber 34 is released past the ring 60 as the ring 60 is pushed in the passage 44 toward the chamber 34. Conversely, a vacuum is generated in the chamber 34 as the ring 60 is withdrawn in the passage 44 away from the chamber 34 (in the direction of arrow 63 in FIG. 9). The vacuum causes the pouch container 30 to collapse a predetermined amount with each withdrawal of the applicator wand 8 (note the difference in volume between the pouch container 30 in FIG. 8 and FIG. 9). The predetermined amount of collapse of the container is selected to approximate the volume of product withdrawn from the chamber 34 by the applicator 10. Thus, with each withdrawal of the ring 60 the pouch container 30 collapses further, which in turn pushes the remaining product in the pouch container toward the applicator 10. In this way, nearly all of the product in the storage chamber can be dispensed, with little or no waste in the form of product remaining in the package that is inaccessible to the applicator.

Figure 10:
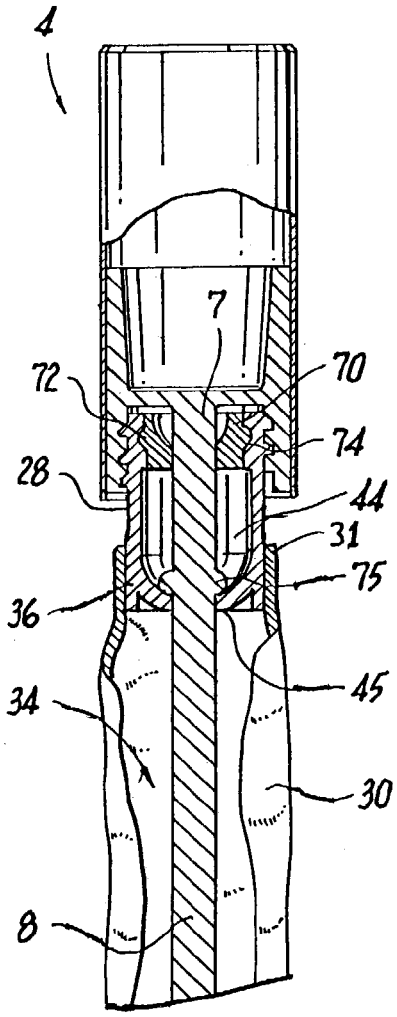
FIG. 10 is a partial sectional view of an alternative embodiment of the invention wherein the vacuum means is an annular ring that is slidable on the wand.
Figure 11:
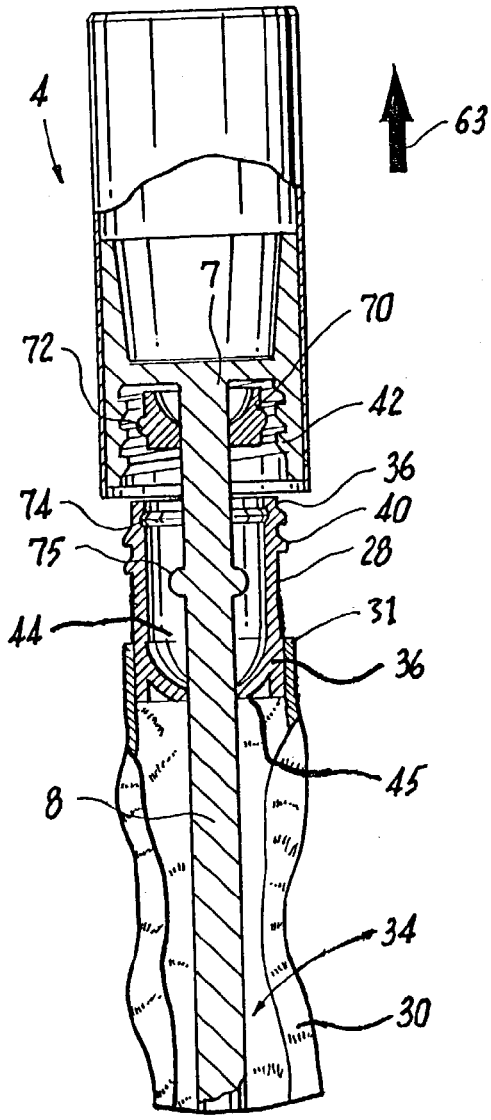
FIG. 11 is a sectional view of the embodiment of FIG. 10 showing the cap off.

In alternative embodiments shown in FIGS. 10-13, the vacuum means consists of an elastic ring 70 slidably mounted about the wand 8. As shown in FIGS. 10-11, when the cap 4 is in the closed position, an outwardly directed annular ridge 72 on the ring 70 engages an annular groove 74 on inwardly directed surface of the passage 44 in neck member 28. This engagement initially retains the ring 70 in the top of the passage 44, preventing the ring 70 from moving out of the passage 44 as the cap 4 is unfastened for removal (in the direction of arrow 63). However, as the wand is withdrawn through the passage 44, a ferrule 75 on wand 8 pushes against the bottom of ring 70 such that ridge 72 disengages from groove 74, and the ring is free to move out of passage 44. The ring is also free to move along the wand 8 between the ferrule 75 and the proximal end 7 of the wand. When the wand is returned to the passage 44 (i.e., in a direction opposite that of arrow 63), the proximal end 7 of wand 8 pushes against the top of ring 70 such that the ridge 72 is pushed back into engagement with groove 74. This controlled movement of the ring 70 with respect to the wand 8 and the passage 44 acts to meter the amount of vacuum applied to the chamber 34.

Figure 12:
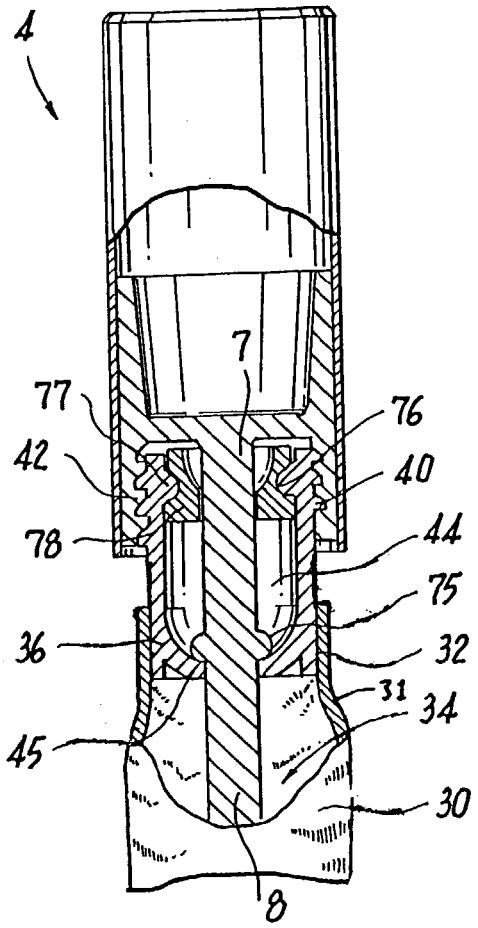
FIG. 12 is a sectional view of an alternative embodiment of the invention as shown in FIG. 10.
Figure 13:
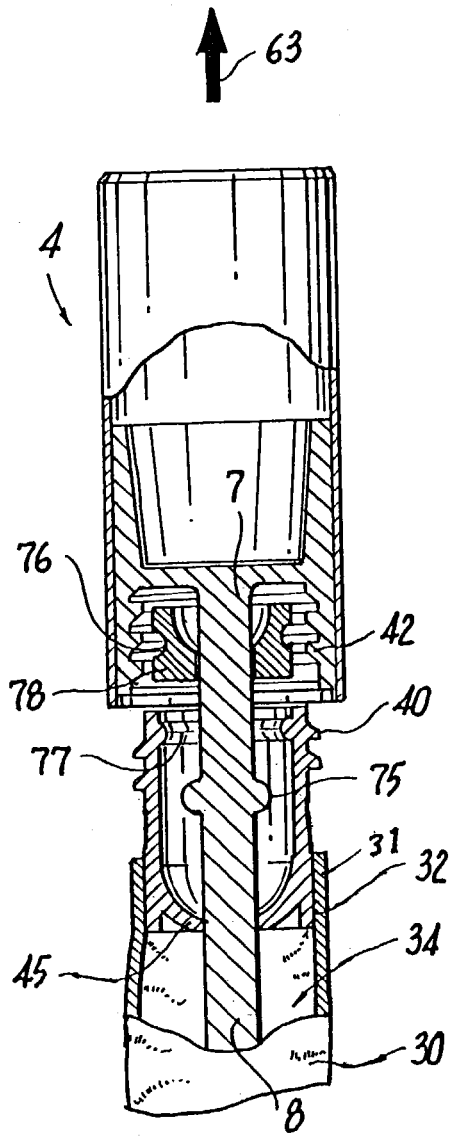
FIG. 13 is a sectional view of the embodiment of FIG. 12 showing the cap off.
Figure 14:
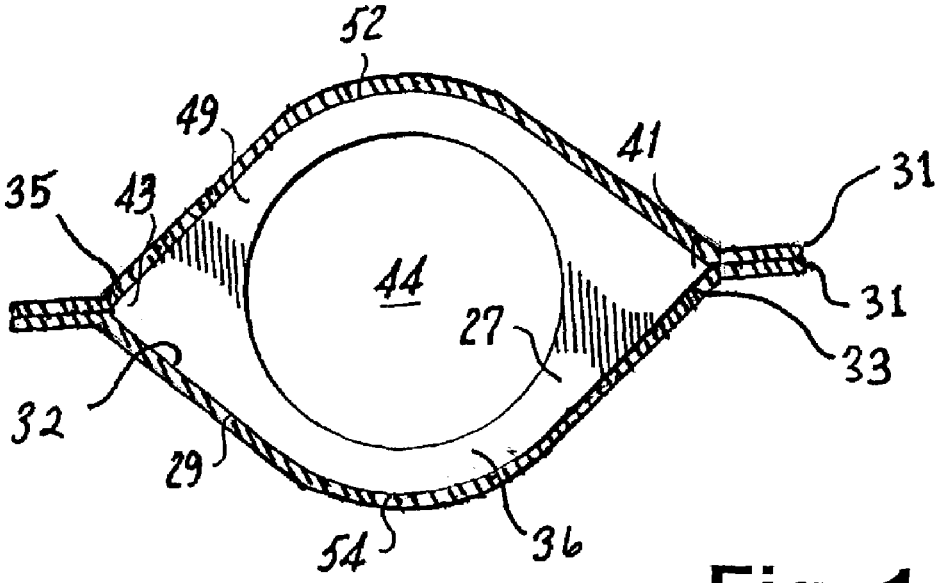
FIG. 14 is a bottom view of the neck member from within a section of the pouch container.

In FIGS. 12-13, the arrangement is similar to that shown in FIGS. 10-11, i.e., the vacuum means consists of an elastic ring 78 slidably mounted about the wand 8. However, in the embodiment shown in FIGS. 12-13, when the cap 4 is in the closed position, an outwardly directed annular groove 76 on the ring 78 engages an annular ridge 77 on the inwardly directed surface of the passage 44 in neck member 28. This engagement initially retains the ring 78 in the top of the passage 44, preventing the ring 78 from moving out of the passage 44 as the cap 4 is unfastened for removal (in the direction of arrow 63). However, as the wand is withdrawn through the passage 44, the ferrule 75 on wand 8 pushes against the bottom of ring 78 such that ridge 77 disengages from groove 76, and the ring is free to move out of passage 44. The ring is also free to move along the wand 8 between the ferrule 75 and the proximal end 7 of the wand. When the wand is returned to the passage 44 (i.e., in a direction opposite that of arrow 63), the proximal end 7 of the wand 8 pushes against the top of ring 78 such that the ridge 77 engages with groove 76 on ring 78. This controlled movement of the ring 78 with respect to the wand 8 and the passage 44 acts to meter the amount of vacuum applied to the chamber 34.

The package is simple in design, cost effective to manufacture and assemble, may be pre-loaded with product, and is adaptable for a variety of different cosmetic package applications.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A cosmetic package comprising:

a pouch container defining a product storage chamber, the container having an opening;

a neck member having:

a first end having a pair of horizontal wedges extending radially from opposite sides, each wedge attached to the first end by way of a base substantially as broad as a width of the first end, and each wedge tapering from the base to a distal edge defining an acute angle, the wedges and intervening portions of the first end defining opposite outwardly directed bonding surfaces, the opening of the pouch container fixedly attached to and forming an impervious seal with the bonding surfaces;

a second end opposite the first end; and a passage from the first end to the second end of the neck member, the passage providing access through the neck member to the chamber;

a cap adapted to selectively open and close the passage by engaging cooperative means on the second end;

an applicator wand with a proximal end connected to the cap and a distal end extending from the cap, the wand dimensioned to be received in the passage and having a sufficient length to position the distal end of the wand within the chamber when the cap is at least proximal to the second end of the neck; wherein the passage has a circular cross-section and the cosmetic package further comprises:

an elastic annular ring mounted about the wand and positioned at a location along a length of the wand corresponding to a point between the first end and the second end of the neck when the cap is engaged with the second end, the ring having an outer dimension that is the same as or slightly larger than an inner dimension of the passage, the ring configured and biased with respect to the passage such that compression in the chamber is released as the ring is pushed in the passage toward the chamber and a vacuum is generated in the chamber as the ring is withdrawn in the passage away from the chamber, wherein, the pouch container collapses a predetermined amount each time the wand is withdrawn from the passage.

2. The cosmetic package of claim 1 wherein the ring is fixedly mounted to the wand.

3. The cosmetic package of claim 1 further comprising a ferrule fixedly positioned on the wand between the proximal end and the distal end, wherein the ring is slidably mounted on the wand and is movable on the wand between the ferrule and the proximal end.

4. A cosmetic package comprising:

a pouch container defining a product storage chamber, the container having an opening;

a neck member having:

a first end having a pair of horizontal wedges extending radially from opposite sides, each wedge attached to the first end by way of a base substantially as broad as a width of the first end, and each wedge tapering from the base to a distal edge defining an acute angle, the wedges and intervening portions of the first end defining opposite outwardly directed bonding surfaces, the opening of the pouch container fixedly attached to and forming an impervious seal with the bonding surfaces:

a second end opposite the first end; and a passage from the first end to the second end of the neck member, the passage having a circular cross-section and providing access through the neck member to the chamber;

a cap adapted to selectively open and close the passage by engaging cooperative means on the second end;

an applicator wand with a proximal end connected to the cap and a distal end extending from the cap, the wand dimensioned to be received in the passage and having a sufficient length to position the distal end of the wand within the chamber when the cap is at least proximal to the second end of the neck;

an elastic annular ring mounted about the wand and positioned at a location along a length of the wand corresponding to a point between the first end and the second end of the neck when the cap is engaged with the second end, the ring having an outer dimension that is the same as or slightly larger than an inner dimension of the passage, the ring configured and biased with respect to the passage such that compression in the chamber is released as the ring is pushed in the passage toward the chamber and a vacuum is generated in the chamber as the ring is withdrawn in the passage away from the chamber, wherein, the pouch container collapses a predetermined amount each time the wand is withdrawn from the passage; and a ferrule fixedly positioned on the wand between the proximal end and the distal end, wherein the ring slidably mounted on the wand and is movable on the wand between the ferrule and the proximal end;

wherein an outwardly directed surface of the ring is provided with one of an annular ridge and an annular groove, and an inwardly directed surface of the neck member is provided with the other of an annular ridge and an annular groove, the respective ridge and groove engaging sufficiently to initially limit movement of the ring when the wand is withdrawn from the passage.

* * * * *